US007310860B2

(12) United States Patent
Münstermann

(10) Patent No.: US 7,310,860 B2
(45) Date of Patent: Dec. 25, 2007

(54) MAKING NONWOVEN FIBER PRODUCTS WITH NEEDLE-JET CONSOLIDATION

(75) Inventor: Ulrich Münstermann, Egelsbach (DE)

(73) Assignee: Fleissner GmbH, Egelsbach (DE)

( * ) Notice: Subject to any disclaimer, the term of this patent is extended or adjusted under 35 U.S.C. 154(b) by 0 days.

(21) Appl. No.: 10/573,530

(22) PCT Filed: Sep. 3, 2004

(86) PCT No.: PCT/EP2004/052040

§ 371 (c)(1),
(2), (4) Date: Nov. 13, 2006

(87) PCT Pub. No.: WO2005/031056

PCT Pub. Date: Apr. 7, 2005

(65) Prior Publication Data

US 2007/0067972 A1 Mar. 29, 2007

(30) Foreign Application Priority Data

Sep. 25, 2003 (DE) ..... 103 44 672

(51) Int. Cl.
*D04H 1/46* (2006.01)

(52) U.S. Cl. ..... 28/104; 28/167

(58) Field of Classification Search ..... 28/104, 28/105, 106, 167, 103; 8/148, 149; 156/290, 156/291; 264/557; 442/408; 428/196, 58
See application file for complete search history.

(56) References Cited

U.S. PATENT DOCUMENTS

| | | | | |
|---|---|---|---|---|
| 3,047,444 | A * | 7/1962 | Harwood | 28/104 |
| 3,800,364 | A * | 4/1974 | Kalwaites | 28/105 |
| 4,514,455 | A * | 4/1985 | Hwang | 428/198 |
| 4,691,417 | A * | 9/1987 | Vuillaume | 28/105 |
| 5,414,915 | A * | 5/1995 | Pryne | 28/107 |
| 6,568,049 | B1 * | 5/2003 | Putnam | 28/104 |
| 6,782,589 | B2 * | 8/2004 | Ngai | 28/104 |
| 2005/0071966 | A1 * | 4/2005 | Barth et al. | 28/104 |

FOREIGN PATENT DOCUMENTS

FR 2601970 A1 * 1/1988

* cited by examiner

*Primary Examiner*—Amy B. Vanatta
(74) *Attorney, Agent, or Firm*—Andrew Wilford

(57) ABSTRACT

A nonwoven product is made by passing a fiber web longitudinally along a treatment path and preconsolidating it at an upstream location along the path. Then the web is fully consolidated by liquid jets downstream of the location at longitudinally spaced and transversely extending discontinuous strips each interrupted at least two break points. The web is then fully consolidated by liquid jets downstream of the location at least two transversely spaced longitudinally extending strips extending a full length of the web and crossing the transverse strips at the break points. Subsequently the web is cut up into pieces along the strips.

9 Claims, 1 Drawing Sheet

MAKING NONWOVEN FIBER PRODUCTS WITH NEEDLE-JET CONSOLIDATION

CROSS REFERENCE TO RELATED APPLICATIONS

This application is the U.S. national phase of PCT application PCT/EP2004/052040 filed 3 Sep. 2004 with a claim to the priority of German patent application 10344672.9 itself filed 25 Sep. 2003, whose disclosures are herewith incorporated by reference.

FIELD OF THE INVENTION

It is known from WO 02/052083 to place three-dimensional strip goods such as pre-products or intermediate products between two nonwovens, to bond the superposed nonwovens by felting the fibers by hydrodynamic needling, to consolidate them and thereby enclose the goods. This enclosure can be effected by individual intermittently operated nozzles but also by a continuous water curtain from a nozzle beam which is made effective only in part by means of a fully circumferential template. It is also known to provide the nozzle beam with a nozzle strip which is only perforated in sections to bring a pattern into the nonwoven.

OBJECT OF THE INVENTION

It is the object of the invention to provide a method whereby a single nonwoven containing a homogeneous mixture of optionally different fibers but which can also consist merely of cotton, for example, can be consolidated such that the central area remains voluminous whilst the edge zones are fully consolidated.

SUMMARY OF THE INVENTION

Starting from a method for the hydrodynamic consolidation of a substantially homogeneous layer of fibers of any kind, such as especially natural but also and/or synthetic fibers of endless or continuous types, that is a web-like nonwoven, by means of liquid jets emerging continuously from at least two nozzle beams, whereby a liquid is sprayed at high pressure from fine nozzle orifices arranged in a row from at least two nozzle strips extending over the working width in two nozzle beams towards the nonwoven advancing towards the nozzle beams, the solution of the formulated problem is achieved by first consolidating the nonwoven coming from a web-laying device such as a card over the entire area, at least on the surface, and then fully and completely consolidating this pre-consolidated and therefore replaceable nonwoven in a continuous two-stage hydrodynamic consolidation process merely along spaced longitudinal strips and superposed likewise spaced transverse strips by means of a plurality of rows of water jets in each case.

The full-area pre-consolidation, as in the stitch-bonding process or using hydrodynamic needling, can be carried out in a different machine park with the now transportable nonwoven being wound subsequently but it is more advantageous to have continuous treatment until the finished product is achieved in an installation where the speeds of the individual machines are adapted.

The complete consolidation of the nonwoven should thus only take place at certain positions. These positions run along spaced strips both in the transverse and in the longitudinal direction. If the nonwoven is then separated and cut subsequently along this strip, a manipulatable, strip-like nonwoven product is produced continuously, whose edges are consolidated all around but whose central area remains voluminous as achieved by the pre-consolidation. Thus, any fraying of a voluminous strip of nonwoven during further treatment can be avoided.

For the full consolidation the installation for producing the nonwoven consists of a stencil drum or a stencil continuous strip with spaced slits along the drum or an endless strip for the transverse strips with internally arranged nozzle beams and further nozzle beams directly allocated to the nonwoven, whose nozzle strips have rows of perforations spaced apart from one another for the longitudinal strips.

BRIEF DESCRIPTION OF THE DRAWING

The invention is explained with reference to the drawing as an example. Shown schematically in the figures.

SPECIFIC DESCRIPTION

Figure 1:
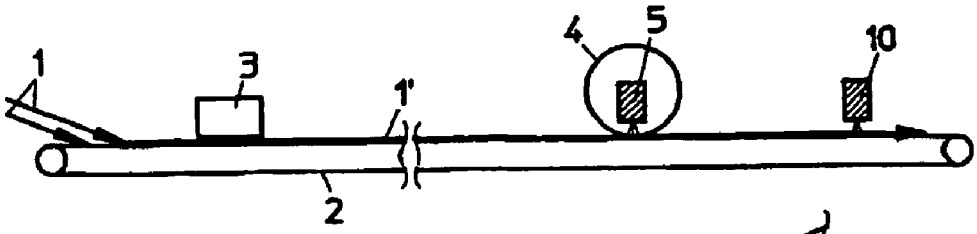
FIG. 1 is a side view of a machine installation for partial consolidation of a nonwoven.

A nonwoven 1 coming from a card or similar web-laying machine, which can be formed of various fibers, in this case however preferably cotton, is laid on an endless strip 2 which conveys the nonwoven through the consolidating installation shown in FIG. 1. First, the looser nonwoven which has not yet been manipulated is consolidated over the full area so that its volume certainly decreases but is retained as far as possible. The stitch-bonding technique should be used for this purpose for example, this being indicated by the unit denoted at 3. Full-area water needling can also be used here but, in this case, the volume after consolidation is not optimal. Depending on the treatment speed of the machines it can be advantageous to wind up the nonwoven 1' which can now be manipulated and placed on the subsequent consolidation installation.

Full consolidation is accomplished by means of water-needle punching but distributed only partly over the surface of the nonwoven 1. In the example, a stencil drum 4 with a water beam 5 extending longitudinally in its interior is initially used for this purpose. The water jets 6 flowing out towards the stencil over the entire length of the water beam 5 are only allowed to pass through at slits 7 provided here and then impact on the nonwoven 1' for full consolidation in the area of these slits 7. The adjacent slits 7 in the longitudinal direction of the stencil drum 4 in total produce transverse strips 9 across the nonwoven 1. For this they are only separated by a small web 8 in relation to the slits 7. The slits 7 can have a width A of 95 mm for example whereas the web 8 between two slits 7 can have a width B of 5 mm.

Figure 2:
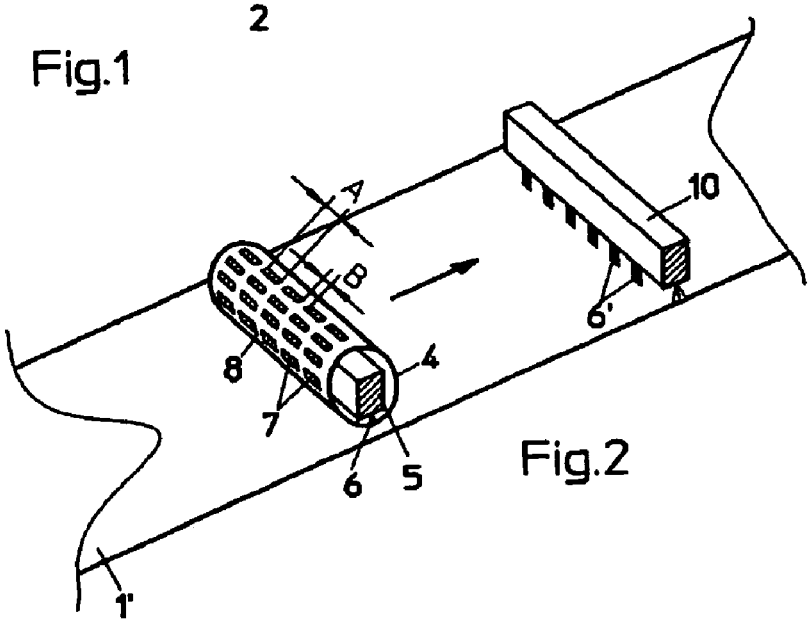
FIG. 2 is a view of the two water needling devices for full consolidation.
Figure 3:
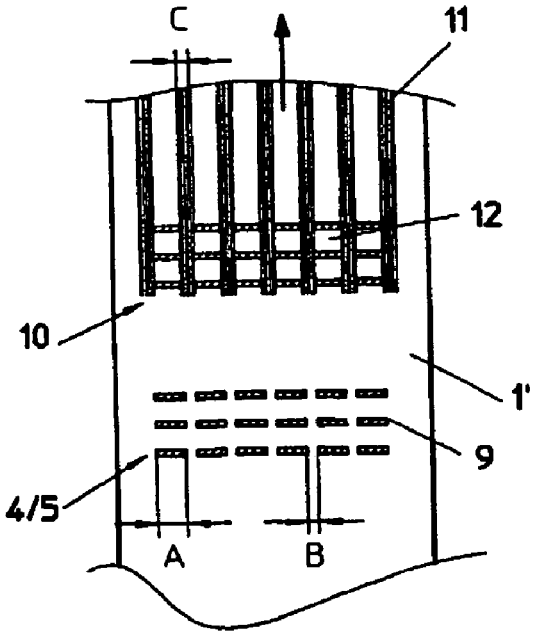
FIG. 3 is a plan view of the treated nonwoven with the individual strips achieved by water needling.

Following the transverse strips 9 produced using the stencil needling, which can also be produced using an endless strip instead of a drum 4, longitudinal strips can be produced in the example. Provided for this purpose is a normal water beam 10 whose nozzle strips are perforated to produce water jets 6' but not over its entire length but only in sections as shown in FIG. 2 so that longitudinal strips 11 are formed over the surface of the nonwoven. In their arrangement over the surface of the nonwoven, the longitudinal strips 11 are coordinated with the breaks of the transverse strips 9 in the area of the webs 8 in the stencil 4. The longitudinal strips 11 should be made on the nonwoven 1 at those points where no consolidation takes place in the stencil treatment. The width C of the longitudinal strips 11 can cover the width B of the breaks as a result of the webs 8. Thus, in connection with the stencil configuration indicated above, the longitudinal strips can have a width C of 10 mm whereas the width B of the webs 5 is 5 mm. In any case, after the second needling using the water beam 10 a checked consolidation is produced around a region 12 which is not affected by the water jets.

Figure 4:
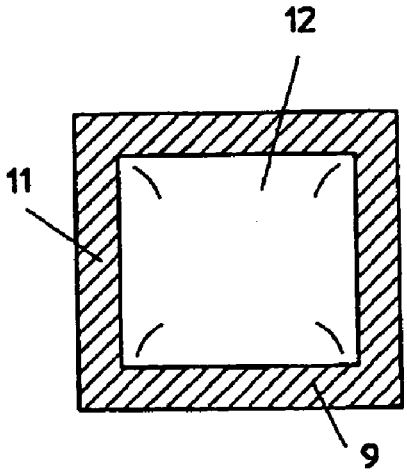
FIG. 4 is a plan view of a voluminous nonwoven product with solid edge strips after making up the nonwoven.

For finishing the nonwoven is now cut longitudinally and transversely and specifically in the areas of full consolidation along the strips 9 and 11. As a result, square nonwoven products are produced as in FIG. 4 which are fully consolidated at the edges but the central region 12 are voluminous. Products of this type are required for example in the hygiene industry.

The invention claimed is:

1. A method of making a nonwoven product, the method comprising the step of:

passing a fiber web longitudinally along a treatment path;

preconsolidating the web at an upstream location along the path;

fully consolidating the web by liquid jets downstream of the location at longitudinally spaced and transversely extending discontinuous strips each interrupted at least two break points; and fully consolidating the web by liquid jets downstream of the location at least two transversely spaced longitudinally extending strips extending a full length of the web and crossing the transverse strips at the break points.

2. The method defined in claim 1 wherein the web is fully consolidated at the transverse strips before being fully consolidated at the longitudinal strips.

3. The method defined in claim 1 wherein the preconsolidation is done by water-jet needling.

4. The method defined in claim 1 wherein the preconsolidation is done by stitch bonding.

5. The method defined in claim 1 wherein the web is moved continuously and the full consolidation at the longitudinal strips is also done continuously.

6. The method defined in claim 1, further comprising the step of cutting the web after formation of the longitudinal and transverse strips into pieces by severing the web along the longitudinal and transverse strips.

7. The method defined in claim 1 wherein the transverse strips are formed by:

continuously directing a transversely extending row of liquid jets against the web from a transversely extending nozzle bar; and interposing a template between the nozzle bar and the web and thereby intercepting the water jets except at locations corresponding to holes in template and to the discontinuous transverse strips.

8. An apparatus for making a nonwoven product, the apparatus comprising:

means for passing a fiber web longitudinally along a treatment path;

means for preconsolidating the web at an upstream location along the path;

means including a plurality of nozzles and a template directed at the web for fully consolidating the web by liquid jets downstream of the location at longitudinally spaced and transversely extending discontinuous strips each interrupted at least two break points; and means including another plurality of nozzles for fully consolidating the web by liquid jets downstream of the location at at least two transversely spaced longitudinally extending strips extending a full length of the web and crossing the transverse strips at the break points.

9. The apparatus defined in claim 8 wherein the nozzles for the longitudinal strips are arranged such that the longitudinal strips have a transverse width greater than a transverse length of the break points, whereby the longitudinal strips overlap portions of the transverse strips bordering the break points.

* * * * *